US007497078B2

(12) United States Patent
Hiranuma et al.

(10) Patent No.: US 7,497,078 B2
(45) Date of Patent: Mar. 3, 2009

(54) EXHAUST EMISSION CONTROL DEVICE OF INTERNAL COMBUSTION ENGINE

(75) Inventors: Satoshi Hiranuma, Tochigi (JP); Ritsuko Shinozaki, Tochigi (JP); Yoshinori Takahashi, Tochigi (JP); Yoshinaka Takeda, Tochigi (JP); Reiko Doumeki, Tochigi (JP); Shinichi Saito, Tochigi (JP); Toru Kawatani, Tochigi (JP); Takeshi Hashizume, Shizuoka (JP); Kenji Kawai, Aichi (JP)

(73) Assignee: Mitsubishi Fuso Truck and Bus Corporation, Tokyo (JP)

( * ) Notice: Subject to any disclaimer, the term of this patent is extended or adjusted under 35 U.S.C. 154(b) by 0 days.

(21) Appl. No.: 10/531,329

(22) PCT Filed: Oct. 16, 2003

(86) PCT No.: PCT/JP03/13221

§ 371 (c)(1),
(2), (4) Date: Sep. 16, 2005

(87) PCT Pub. No.: WO2004/036002

PCT Pub. Date: Apr. 29, 2004

(65) Prior Publication Data

US 2006/0107658 A1 May 25, 2006

(30) Foreign Application Priority Data

Oct. 16, 2002 (JP) ..... 2002-301366

(51) Int. Cl.
*F01N 3/00* (2006.01)

(52) U.S. Cl. ..... 60/295; 60/297; 60/311

(58) Field of Classification Search ..... 60/276, 60/295, 297, 311
See application file for complete search history.

(56) References Cited

U.S. PATENT DOCUMENTS 5,287,698 A * 2/1994 Shinzawa et al. ..... 60/286
5,319,930 A * 6/1994 Shinzawa et al. ..... 60/286
5,746,989 A * 5/1998 Murachi et al. ..... 423/213.7

(Continued)

FOREIGN PATENT DOCUMENTS

EP 1 229 223 A 8/2002

(Continued)

*Primary Examiner*—Thomas E Denion
*Assistant Examiner*—Diem Tran
(74) *Attorney, Agent, or Firm*—Birch, Stewart, Kolasch & Birch, LLP

(57) ABSTRACT

An exhaust gas purifying system reliably detects an amount of accumulated particulates, lengthens forced regeneration intervals, and improves fuel efficiency. The exhaust gas purifying system comprises: a particulate filter 22 disposed in an exhaust system of an internal combustion engine 2 and collecting particulates from exhaust gas, and an $NO_2$ generating unit 21 upstream of or in the particulate filter 22; a discharged particulate amount calculating unit A1 calculates an amount Me of discharged particulates on the basis of an excess air ratio λ; a burnt particulate amount calculating unit A2 calculates an amount Mb of burnt particulates on the basis of the temperature of exhaust gas in front of the particulate filter or the temperature of the particulate filter; and a particulate accumulation amount calculating unit calculates an amount Ma of accumulated particulates on the basis of the amount Me of discharged particulates or the amount Mb of burnt particulates.

4 Claims, 11 Drawing Sheets

U.S. PATENT DOCUMENTS

| | | | | |
|---|---|---|---|---|
| 5,941,066 | A * | 8/1999 | Araki et al. | 60/280 |
| 6,634,345 | B2 * | 10/2003 | Yoshizaki et al. | 123/568.12 |
| 6,655,133 | B2 * | 12/2003 | Mikami et al. | 60/296 |
| 7,137,248 | B2 * | 11/2006 | Schaller | 60/297 |

FOREIGN PATENT DOCUMENTS

| | | | |
|---|---|---|---|
| JP | 64-77718 | A | 3/1989 |
| JP | 7-224635 | A | 8/1995 |
| JP | 2000-161044 | A | 6/2000 |
| JP | 2002-97930 | A | 4/2002 |
| JP | 2002-276422 | A | 9/2002 |
| JP | 2002-285823 | A | 10/2002 |
| JP | 2002-339733 | A | 11/2002 |

* cited by examiner

EXHAUST EMISSION CONTROL DEVICE OF INTERNAL COMBUSTION ENGINE

BACKGROUND OF THE INVENTION

1. Field of the Invention

This invention relates to an exhaust gas purifying system configured to collect carbon particles and so on from exhaust gas of an internal combustion engine, and more particularly to an exhaust gas purifying system which oxidizes and burns carbon particles trapped on a filter using nitrogen dioxide ($NO_2$) generated by an oxidation catalyst.

2. Description of the Related Art

Particulates composed of carbon particles and so on get mixed in exhaust gas of an internal combustion engine, e.g. a diesel engine. A particulate filter is installed in an exhaust passage in order to trap particulates and prevent them from being discharged into the air. When more particulates are accumulated on the particulate filter, they should be burnt in order to regenerate the particulate filter.

In order to overcome the foregoing problem, forced regenerating units are used, which heat the particulate filter and burn particulates when an amount of accumulated particulates exceeds a regeneration reference point. Specifically, the amount of accumulated particulates is detected on the basis of relationship between the flow of exhaust gas and pressure loss of the particulate filter. For instance, some forced regenerating unit injects fuel to a fuel supply system during an expansion stroke or an exhaust stroke after the main fuel injection, and forcibly raises the temperature of exhaust gas. In another example, an electric heater or a gas oil burner is operated to forcibly heat exhaust gas.

The foregoing forced regenerating units tend to reduce the fuel efficiency since particulate filters should be kept hot. In order to overcome this problem, it is necessary to precisely detect forced regeneration timings and lengthen forced regeneration intervals.

Usually, particulates can be oxidized at approximately 600° C. There is a continuous regeneration type filter in which particulates can be burnt at a low temperature of approximately 250° C. This enables particulates to be burnt in a wide temperature range and promotes regeneration of particulate filters.

In the continuous regeneration type filter, an oxidation catalyst is disposed upstream of a particulate filter in an exhaust passage. The oxidation catalyst oxidizes nitric monoxide (NO) and generates nitrogen dioxide ($NO_2$) as expressed by the formula (1).

$$2NO+O_2 \rightarrow 2NO_2 \quad (1)$$

Nitrogen dioxide ($NO_2$) is very active, and promotes the reaction expressed by formulas (2) and (3) when it comes into contact with particulates trapped on the particulate filter, thereby regenerating the particulate filter.

$$NO_2+C \rightarrow NO+CO \quad (2)$$

$$NO_2+CO \rightarrow NO+CO_2 \quad (3)$$

However, the continuous regeneration type filter which can burn particulates at the low temperature fails to raise the temperature of exhaust gas when a vehicle keeps on cruising through town at a low load. In such a case, particulates easily accumulate on the particulate filter, and should be forcibly burnt in order to regenerate the particulate filter.

Therefore, the foregoing continuous regeneration type filter usually includes a forced regeneration unit, which forcibly heats exhaust gas on the particulate filter, and burns particulates when the amount of accumulated particulates is detected to be above the regeneration reference point mentioned above. In this case, the forced regenerating unit injects fuel to a fuel supply system during the expansion stroke or exhaust stroke after the main fuel injection, and forcibly heats exhaust gas.

For instance, the assignee of this application has proposed a method of easily estimating an amount of particulates accumulated on a filter on the basis of an exhaust gas temperature frequency (i.e. at which an exhaust gas temperature is equal to or higher than a predetermined value) as disclosed in Japanese Patent Application No. 2001-144,501 (called the "cited reference 1"). Further, Japanese Patent Laid-Open Publication No. 2002-276,422 (called the "cited reference 2") discloses a continuous regeneration type DPF (diesel particulate filter) in which an oxidation catalyst, a particulate filter and a NOx catalyst are arranged upstream of an exhaust passage in order to operate an engine by increasing an air-to-fuel ratio during the regeneration of the particulate filter.

In either the continuous regeneration type filter or a simple particulate filter, particulates are burnt when the amount of accumulated particulates exceeds a regeneration reference point. If the amount of accumulated particulates is not precisely detected, e.g. if the accumulated amount is recognized to be excessive, regeneration intervals may be shortened, which reduces fuel efficiency. On the contrary, if the accumulated amount is determined to be small, particulates excessively accumulate on the filter, and may damage the filter when burnt. Therefore, it is necessary to precisely detect forced regeneration timings and to lengthen forced regeneration intervals.

The foregoing method allows detection of the amount of accumulated particulates on the basis of the relationship between the flow of exhaust gas and pressure loss of the filter. However, there is a strong demand for a method of precisely estimating an amount of accumulated particulates. Especially, in the case of the continuous regeneration type filter, particulates tend to be partially burnt, which would lead to non-uniform accumulation of particulates, and further adversely affect relationship between the flow rate of exhaust gas, the pressure loss and the amount of accumulated particulates.

The continuous regeneration type filter (of the cited reference 1) is preferably to be improved. This is because the amount of burnt particulates can be estimated while the amount of discharged particulates cannot be accurately estimated, which would adversely affect precise detection of the amount of accumulated particulates. In the continuous regeneration type filter (of the cited reference 2), the timing to regenerate the particulate filter is not determined on the basis of the amount of accumulated particulates, but the particulate filter is regenerated only by increasing the air-to-fuel ratio, which tends to reduce fuel efficiency.

The present invention is intended to provide an exhaust gas purifying system for an internal combustion engine which can precisely detect a forced regeneration timing, lengthen regeneration intervals, and prevent reduction of fuel efficiency.

SUMMARY OF THE INVENTION

According to a first aspect of the invention, there is provided an exhaust gas purifying system for an internal combustion engine, comprising: an exhaust-after-treatment device disposed in an exhaust system of the internal combustion engine, and including a particulate filter configured to collect particulates from exhaust gas, and an $NO_2$ generating unit upstream of or in the particulate filter; a discharged particulate amount calculating unit configured to calculate an amount of discharged particulates on the basis of an excess air ratio; a burnt particulate amount calculating unit configured to calculate an amount of burnt particulates on the basis of a temperature of exhaust gas in front of the particulate filter or a temperature of the particulate filter; and a particulate accumulation amount calculating unit configured to calculate an amount of accumulated particulates on the basis of the calculated amount of discharged particulates or the calculated amount of burnt particulates.

The amount of accumulated particulates can be precisely detected by calculating the amount of burnt particulates on the basis of the exhaust gas temperature or the filter temperature, and by calculating the amount of discharged particulates on the basis of the excess air ratio. This is effective in properly setting up forced regeneration intervals.

The exhaust gas purifying system preferably includes a forced regeneration system which raises the temperature of exhaust gas by injecting additional fuel in an expansion or exhaust stroke after the main fuel injection or provides hydrocarbon HC to a catalyst or the filter in order to burn particulates on the filter, when the amount of accumulated particulates exceeds a predetermined value. In such a case, a light oil burner or an electric heater is usable for the forced regeneration.

In accordance with a second aspect of the invention, there is provided an exhaust gas purifying system for an internal combustion engine, comprising: an exhaust-after-treatment device disposed in an exhaust system of the internal combustion engine, and including a particulate filter configured to collect particulates from exhaust gas, and an $NO_2$ generating unit upstream of or in the particulate filter; an excess air ratio deviation frequency calculating unit configured to calculate a frequency at which an excess air ratio is equal to or less than a predetermined value during the operation of the internal combustion engine; a discharged particulate amount calculating unit configured to calculate an amount of discharged particulates on the basis of the excess air ratio frequency at which the excess air ratio is equal to or less than the predetermined value; a filter temperature frequency calculating unit configured to calculate a filter frequency at which the temperature of exhaust gas in front of the particulate filter or the temperature of the particulate filter is equal to or higher than a predetermined value; a burnt particulate amount calculating unit calculating an amount of burnt particulates on the basis of the frequency at which the temperature of exhaust gas or the temperature of the particulate filter is equal to or high than the predetermined value; and a particulate accumulation amount calculating unit configured to calculate an amount of particulates accumulated on the particulate filter on the basis of the calculated amount of discharged particulates and the calculated amount of burnt particulates.

The amount of burnt particulates is calculated on the basis of the particulate burning velocity which depends upon the exhaust gas temperature or upon the filter frequency at which the filter temperature is equal to or higher than the predetermined value. Further, the amount of discharged particulates is calculated on the basis of the excess air ratio frequency at which the excess air ratio is equal or less than the predetermined value. Therefore, the amount of accumulated particulates can be precisely detected, which is effective in properly setting up the forced regeneration intervals.

The discharged particulate amount calculating unit calculates an amount of particulates discharged in a given time period during which the excess air ratio is equal to or less than the predetermined value. The burnt particulate amount calculating unit includes a burning velocity calculating section which calculates a velocity for burning particulates on the particulate filter on the basis of the filter temperature frequency at which the temperature of exhaust gas in front of the particulate filter or the temperature of the particulate filter is equal to or higher than the predetermined value, and derives an amount of particulates burnt in the given time period on the basis of the particulate burning velocity in the given time period and the amount of particulates accumulated in the given time period. The particulate accumulation amount calculating unit calculates an amount of currently accumulated particulates on the basis of the amount of previously accumulated particulates, the amount of particulates discharged during the given time period, and the amount of burnt particulates in the given time period.

The amount of particulates burnt in the given time period is calculated on the basis of the particulate burning velocity in the given time period and the amount of previously accumulated particulates. The amount of particulates discharged in the given time period is calculated on the basis of the excess air ratio frequency at which the excess air ratio is equal to or less than the predetermined value in the given time period. Further, the amount of currently accumulated particulates is calculated on the basis of the amount of previously accumulated particulates, the amount of particulates accumulated in the given time period, and the amount of particulates burnt in the given time period. Therefore, the amount of currently accumulated particulates can be precisely detected, which is effective in properly setting up the forced regeneration intervals.

Alternatively, the particulate accumulation amount calculating unit may calculate the excess air ratio frequency in a given time period by weight-averaging the excess air ratio frequency, at which the excess air ratio is equal to or less than the predetermined value, through the use of a weighting factor wf. In this case, the factor wf is assumed to be 0.5. The nearer the weighting factor wf becomes 1, the less influence of the previous excess air ratio frequency. The use of the excess air ratio frequency calculated using the weighting factor wf is effective in adjusting variations of data caused by disturbance. Therefore, the amount of discharged particulates can be precisely detected.

Still further, the discharged particulate amount calculating unit may calculate an excess air ratio frequency $\beta_i$ in a given time period when the excess air ratio is equal to or less than the predetermined value, using the following formula.

$$\beta_i=(xi+\beta_{i-1}\times(i-1))/i$$

where: xi (i.e. an i-th determination value) is 1 when the excess air ratio is equal to or less than the predetermined value, and xi is 0 when the excess air ratio is above the predetermined value; $\beta_i$ is an i-th excess air ratio frequency; $\beta_{i-1}$ denotes an excess air ratio frequency prior to the i-th excess air ratio frequency.

The filter temperature frequency at which the filter temperature is equal to or more than the predetermined value may be calculated similarly. This is effective in detecting the amount of discharged particles.

The given time period may be the unit time, a time period in which a predetermined amount of fuel is consumed, or a time period for a vehicle to run a certain distance. In this case, the foregoing effects can be accomplished.

The calculation of the amount of discharged particulates includes: downloading data on an amount of intake air and data on an amount of injected fuel: calculating an excess air ratio $\lambda$ in the given time period $\Delta t$ on the basis of the amount of intake air and the amount of injected fuel; calculating an excess air ratio frequency $\gamma\Delta t$ in, in which the excess air ratio $\lambda$ is the predetermined value or less in the given time period $\Delta t$, on the basis of the excess air ratio $\lambda$; and calculating the amount of discharged particulates $Me\Delta t$ $\{=f(\lambda\Delta t\}$. The foregoing procedures are sequentially executed.

The amount of particulates discharged in the given time interval can be precisely calculated. This promotes precise detection of the amount of currently accumulated particulates, and establishes proper forced regeneration intervals.

Further, the calculation of the amount of burnt particulates includes: downloading a catalyst temperature gt; calculating a filter gas temperature frequency $\beta\Delta t$ in a given time period $\Delta t$ on the basis of the catalyst temperature gt; correcting the filter temperature frequency $\beta\Delta t$ using a correction factor K which depends upon an index NOx/Soot representing that components of exhaust gas are suitable for burning particulates; calculating a burning velocity coefficient $\alpha\Delta t$ $\{=f(\beta\Delta t)\}$ for the given time period $\Delta t$; and calculating an amount $Mb\Delta t$ $\{=\alpha\Delta t\times PM_{i-1}\}$ of burnt particulates on the basis of an amount $Ma_{i-1}$ of previously accumulated particulates and the burning velocity coefficient $\alpha\Delta t$, the foregoing procedures being conducted in the named order.

The amount of particulates burnt in the given time interval can be precisely calculated. This promotes precise detection of the amount of currently accumulated particulates, and establishes proper forced regeneration intervals.

DETAILED DESCRIPTION OF THE INVENTION

The invention will be described with reference to a first embodiment shown in FIG. 1 to FIG. 7.

Figure 1:
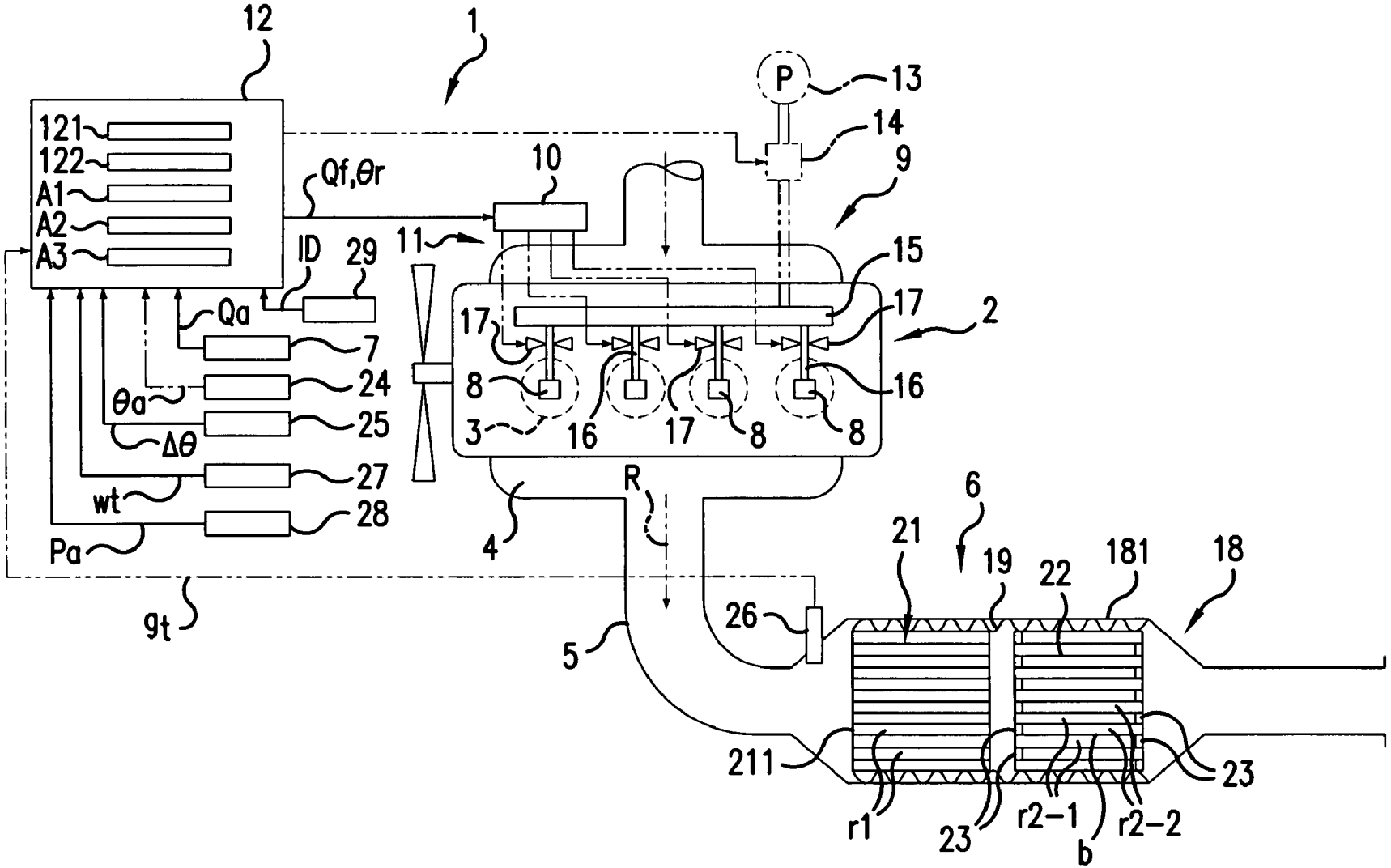
FIG. 1 shows a schematic arrangement of a first embodiment of an exhaust gas purifying system for an internal combustion engine according to the present invention.

Referring to FIG. 1, an exhaust gas purifying system 1 is installed in a diesel engine 2 (called the "engine 2" hereinafter). The engine 2 includes an exhaust passage R extending from a combustion chamber 3. The exhaust passage R connects to an exhaust manifold 4, an exhaust pipe 5, an exhaust-after-treatment device 6 interposed in the exhaust pipe 5 and a silencer (not shown). The engine 2 is an in-line four-cylinder engine. Each cylinder is provided with an injector 8, to which a fuel supplying section 9, and a fuel injecting section 11 are connected. The fuel injecting section 9 injects fuel to the combustion chamber 3 via the injector 8. An engine control unit ECU12 controls the injectors 8 and members connected thereto.

The fuel supply section 9 stabilizes high pressure fuel from a high pressure fuel pump 13 under the control of a fuel pressure regulator 121 in the engine control unit ECU12, and introduces the stabilized fuel to a common rail 15. The fuel is then supplied to each injector 8 via a fuel pipe 16 branching from the common rail 15. In the injector 8, a magnetic valve 17 is connected to an injection controller 122, which provides the magnetic valve 17 with output signals representative of an amount of fuel to be injected and an injection timing, thereby controlling the operation of the injectors 8.

The injection controller 122 calculates the amount of fuel to be injected and injection timing in accordance with an engine speed Ne and an amount $\theta$ a of accelerator pedal depression. Thereafter, the injection controller 122 outputs the calculated results to an injector driver 10, which transfers them to the magnetic valve 17 of the fuel injecting section 11.

The exhaust-after-treatment device 6 is housed in a metal casing 18. An oxide catalyst 21 and a diesel particulate filter 22 (called the "filter 22") are placed in series in a bulging part 181 of the casing 18 via a support 19 made of asbestos or a bulky metal wire netting.

The oxide catalyst 21 is housed in a catalyst holder 211, in which a plurality of exhaust passages r1 are formed. The exhaust passages r1 are open at their opposite ends and enable exhaust gas to pass therethrough. The catalyst holder 211 is made of ceramics and has a monolithic honeycomb structure. The exhaust passages r1 are in parallel with one another in the catalyst holder 211, and hold the oxide catalyst 21 therein.

The oxide catalyst 21 oxidizes nitric monoxide NO in exhaust gas from the engine 2 using oxygen $O_2$, and generates very active nitrogen dioxide $NO_2$, i.e. the oxide catalyst 21 should promote the generation of $NO_2$ as expressed in the formula (1). In order to meet this requirement, a platinum group oxide catalyst is employed in the invention.

The filter 22 is made of ceramics, e.g. cordierite mainly containing Mg, Al and Si, and has a honeycomb structure in order to constitute a plurality of upstream and downstream exhaust passages r2 (r2-1 and r2-2) which are aligned toward the exhaust pipe 5 and are in parallel with one another. Adjacent exhaust passages r2 are alternately opened or closed at their front or rear ends 23. Exhaust gas is introduced into each upstream exhaust passage r2-1, passes through a wall b defining the exhaust passage r2-1, reaches each downstream exhaust passage r2-2 having an open end, and is discharged into the air. In this process, particulates are filtered from exhaust gas.

The engine control unit ECU12 is connected to an air flow sensor 7 detecting an amount Qa of intake air, an accelerator opening sensor 24 detecting an opening angle θ a of an accelerator pedal of the engine 2, a crank angle sensor 25 detecting crank angle data Δθ, an exhaust temperature sensor 26 detecting the temperature gt of exhaust gas, a water temperature sensor 27 detecting the water temperature wt, an atmospheric pressure sensor 28, and an idle switch 29 outputting an idle signal ID. The crank angle data Δθ is used for the engine control unit ECU12 to derive an engine speed Ne and to control a fuel injection timing (to be described later).

Further, the engine control unit ECU12 is provided, in its output and input circuits, with a plurality of ports in order to download a variety of signals from the accelerator pedal opening sensor 24, crank angle sensor 25, exhaust temperature sensor 26, water temperature sensor 27, atmospheric pressure sensor 28 and so on. Still further, the engine control unit ECU12 includes a fuel pressure controller 121, an injection controller 122, and a forced regeneration control section, which includes a unit A1 calculating an amount of discharged particulates, a unit A2 calculating an amount of burnt particulates, and a unit A3 calculating an amount of accumulated particles (refer to FIG. 2), all of which are well-known.

Figure 3A:
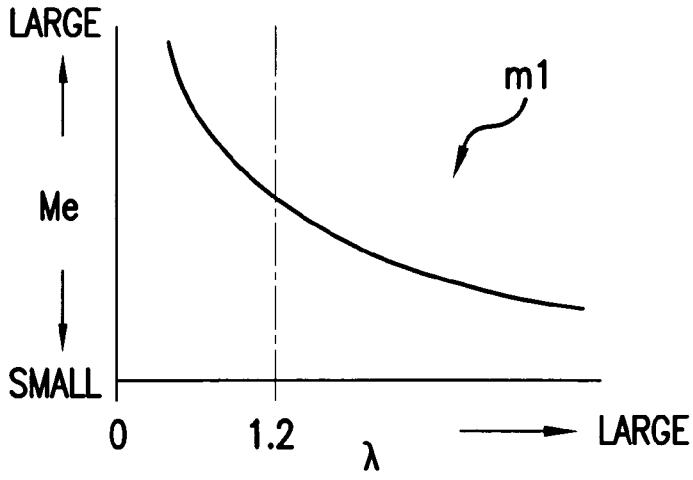
FIG. 3A shows a map for estimating an amount of discharged particulates on the basis of an excess air ratio.

The unit A1 calculates the amount Me of discharged particulates on the basis of an excess air ratio λ, and using a map m1 (FIG. 3A).

The unit A2 calculates an amount Mb of burnt particulates on the basis of the temperature gt of exhaust gas in front of the filter 22 or the temperature of the filter 22. The temperature of the filter 22 is considered to be equal to the exhaust gas temperature, and is also represented by "gt".

The unit A3 calculates an amount Ma of particulates accumulated on the filter 22 on the basis of the amount Me of discharged particulates and the amount Mb of burnt particulates.

When the engine 2 provided with the exhaust gas purifying system 1 is started, the engine control unit ECU12 checks, in a main routine (not shown), whether or not the signals from the foregoing sensors are normal. When they are normal, the engine 2 will be activated.

During the operation of the engine 2, exhaust gas flows into a plurality of exhaust passages r1 of the catalyst holder 211, so that nitrogen monoxide (NO) in exhaust gas is oxidized and changes into very active nitrogen dioxide ($NO_2$), as expressed by the formula (1). Exhaust gas with nitrogen dioxide $NO_2$ is guided to the filter 22. In the filter 22, exhaust gas passes through the walls b defining the exhaust passages r2-1, reaches the exhaust passages r2-2, and is discharged into the air. Particulates are trapped in the filter 22 while exhaust gas passes through the walls b.

Figure 6:
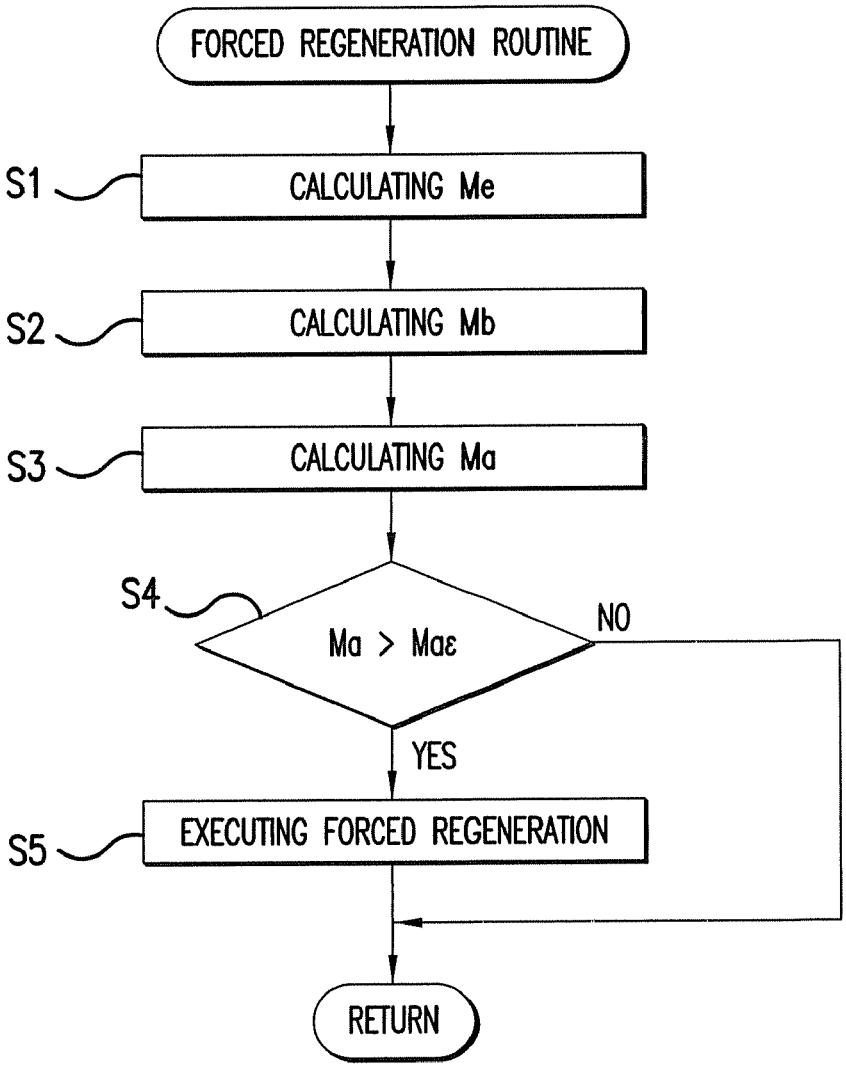
FIG. 6 is a flow chart of a forced regeneration routine of the exhaust gas purifying system.

In this state, the forced regeneration control is executed in the main routine shown in FIG. 6.

During the forced regeneration control, the following are calculated: the amount Me of discharged particulates in step s1; the amount Mb of burnt particulates in step s2; and the amount Ma of accumulated particulates in step s3. When the amount Ma of accumulated particulates is greater than a predetermined threshold Maϵ in step s4, the control process is advanced to step s5, where the forced regeneration control will be performed in order to forcibly regenerate the filter 22 (e.g. post-injection control will be carried out for a predetermined time period).

Figure 2:
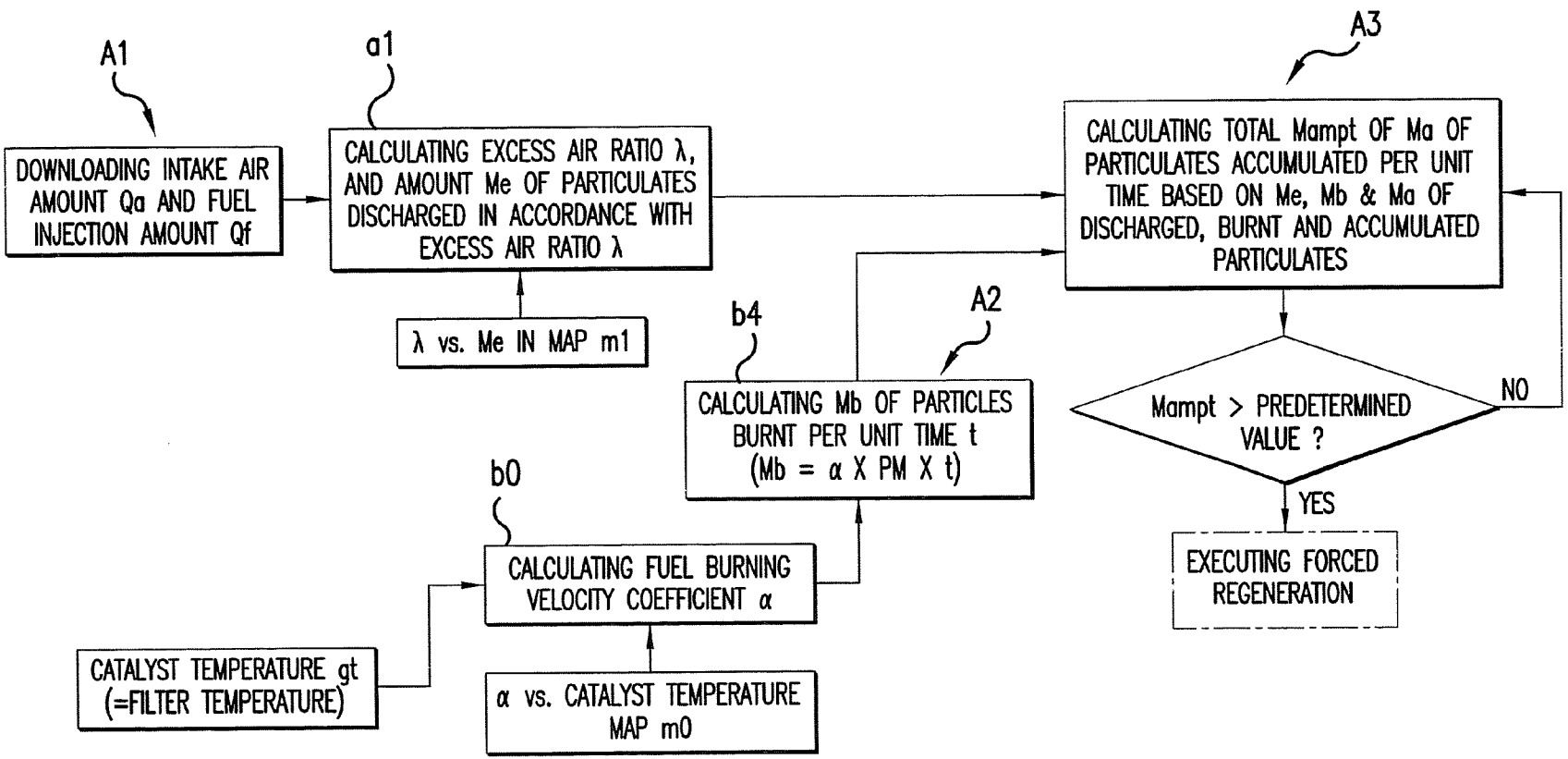
FIG. 2 is a block diagram showing functions of the exhaust gas purifying system of FIG. 1.

The procedures shown in solid line squares in FIG. 2 are executed during the calculation of the amount Me of discharged particulates in step s1. The unit A1 downloads a latest amount Qa of intake air and a latest amount Qf of injected fuel, and calculates an excess air ratio λ {=Qa/(Qf×14.7)} using an excess air ratio calculator a1. The excess air ratio calculator a1 also calculates an amount Me of particulates discharged in response to the excess air ratio λ, using the map m1 showing the amount of discharged particulates. The map m1 is prepared beforehand, and shows that as the excess air ratio λ is lowered, the more abruptly the amount Me of discharged particulates increases.

In step s2, the unit A2 downloads the filter temperature gt and operates a simplified calculator b0 in order to calculate the amount Mb of burnt particulates. Refer to FIG. 2.

Specifically, the simplified calculator b0 calculates a burning velocity coefficient α corresponding to the filter temperature gt. The map m0 shown in FIG. 3(*c*) is used for this purpose. The map m0 shows that the burning velocity coefficient α increases in response to the filter temperature gt.

A calculator b4 calculates the amount Mb of burnt particulates on the basis of the formula (b).

$$Mb=\alpha\times PM\times t \tag{b}$$

where PM denotes an amount of particulates accumulated at a time of measurement and corresponds to an amount of previously accumulated particulates, and "t" denotes a unit time.

In step s3, the unit A3 calculates the amount Ma of accumulated particulates, as shown in FIG. 2, using the following formula (c).

$$Ma=Me-Mb \tag{c}$$

where Me denotes the amount of particulates discharged per unit time t.

The amount of $Ma_i$ of currently accumulated particulates is added to the an amount $Ma_{i-1}$ of particulates previously accumulated during a predetermined time period mt, so that a total amount Maptm of particulate is derived.

In step s4, it is checked whether or not the total amount Maptm is above the predetermined threshold Maϵ. The calculations in steps s1 to s4 are repeated until the amount Maptm is above the predetermined threshold Maϵ. The threshold Maϵ is determined in order to prevent the filter 22 from being overheated and damaged when particulates thereon are continuously burnt.

Figure 7:
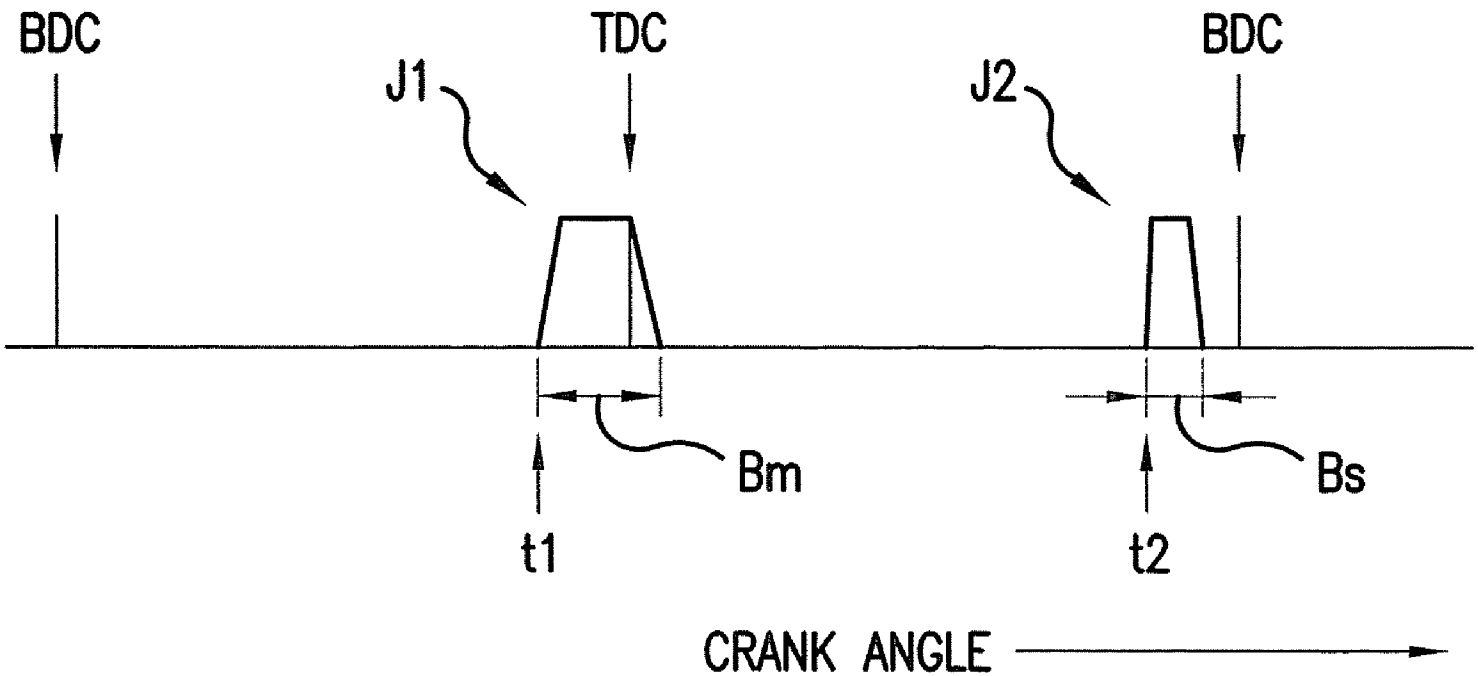
FIG. 7 is a chart for explaining post fuel injection executed in step s5 of the forced regeneration routine of FIG. 6.

When Maptm>Maϵ, post-fuel injection is conducted for a predetermined time period in step s5 in order to forcibly heat and regenerate the filter 22. Specifically, as shown in FIG. 7, not only an amount INJn of fuel injected (for an injection period Bm) in the main injection J1 but also a fuel injection timing t1 are calculated in accordance with a current state of the engine 2. Further, a post injection amount INJp of fuel to be post-injected (for an injection period Bs) is set to a fixed value at a fuel injection timing t2 after the main fuel injection.

The following data are sent to the fuel injection driver 10: an output Dinj representing the fuel injection amount INJn and the fuel injection timing t1; and an output D'inj representing the post injection amount INJp and the post fuel injection timing t2. Then, the control process returns to the main routine. Thereafter, the fuel injection driver 10 counts unit crank angles Δθ for a predetermined number of times from a reference timing (TDC) till a fuel injection timing θr, carries out the main and post fuel injections J1 and J2. Exhaust gas is heated, hydrocarbon HC is burnt on the oxide catalyst a, the temperature gt of the filter 22 is quickly raised, and particulates are burnt in a hot atmosphere for a time period which depends upon the amount of accumulated particulates. As a result, the filter 22 is reliably regenerated in the forced regeneration process.

The amount Ma of accumulated particulates can be accurately detected by calculating the amount Me of discharged particulates on the basis of the excess air ratio λ and by calculating the amount Mb of burnt particulates on the basis of the filter temperature gt. Further, the time intervals between the previous and current regenerations can be properly set, which is effective in maintaining the fuel efficiency in a proper range.

The filter 22 is forcibly heated by the post fuel injection J2 in the expansion stroke after the main fuel injection J1, so that it is not necessary to provide any special external heat source for the forced regeneration. This is effective in simplifying the exhaust gas purifying system. Alternatively, a light oil burner or an electric heater (not shown in FIG. 6) may be provided in the exhaust-after-treatment device as a forced regeneration unit, and be activated in order to promote the regeneration of the filter 22 in step s5. In such a case, the fuel control system may be controlled in a simple manner.

An exhaust gas purifying system will be further described with reference to a second embodiment shown in FIGS. 8 and 9. The exhaust gas purifying system is configured similarly to that of the first embodiment.

Figure 8:
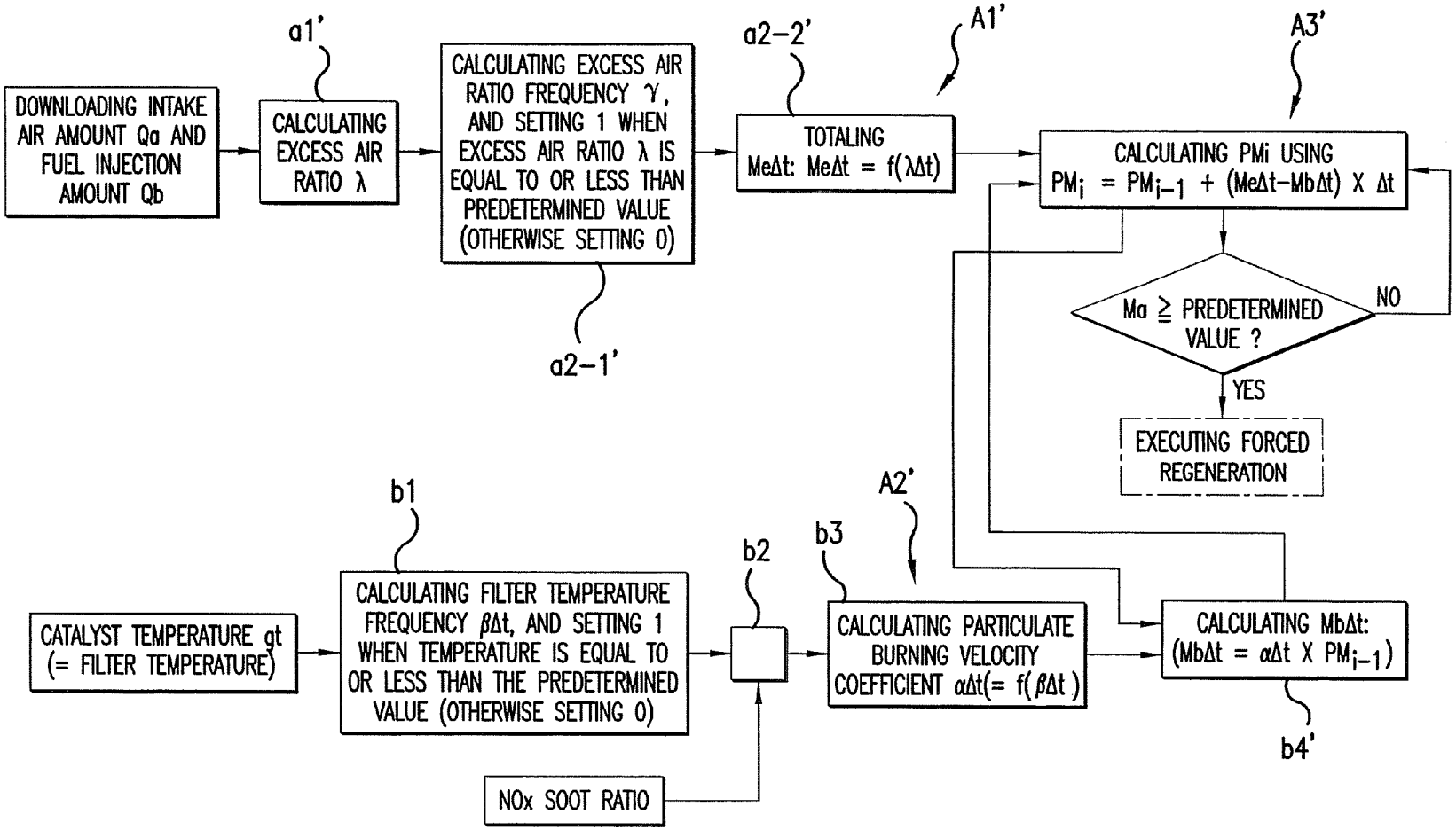
FIG. 8 is similar to FIG. 2, but showing functions of an exhaust gas purifying system according to a second embodiment of the invention.

Referring to FIG. 8, a unit A1' calculates the amount of discharged particulates, a unit A2' calculates the amount of burnt particulates, and a unit A3' calculates the amount of accumulated particulates.

Figure 4A:
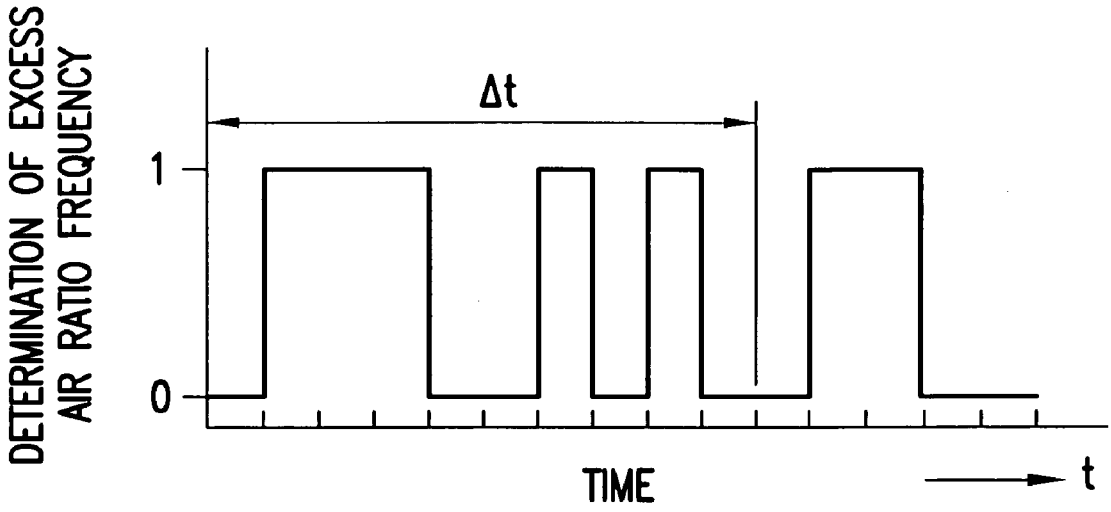
FIG. 4A shows a map for explaining time-dependent variations of an excess air ratio frequency at which the excess air ratio is equal to or less than a predetermined value, used for forced regeneration of the filter.

First of all, the unit A1' calculates the excess air ratio λ{=Qa/(Qf×14.7)} using an excess air ratio calculator a1'. A section a2-1' calculates an excess air ratio frequency γ at which the excess air ratio λ is equal to or less than the predetermined value in a given time interval Δt. Referring to FIG. 4A, when the excess air ratio λ is equal to or less than the predetermined value (e.g. 1.2), a determination value x is set to 1. On the contrary, when the excess air ratio λ is above than the predetermined value, the determination value x is set to 0. Based on the foregoing determination, the excess air ratio frequency γ is calculated using the moving weight average formula (g).

$$\gamma i=(\gamma_{i-1}\times(i-1)+\gamma i)/i \quad \text{(g)}$$

where γi denotes an i-th excess air ratio frequency, and $\gamma_{i-1}$ denotes an excess air ratio frequency prior to the excess air ratio frequency $\gamma_i$.

Figure 4B:
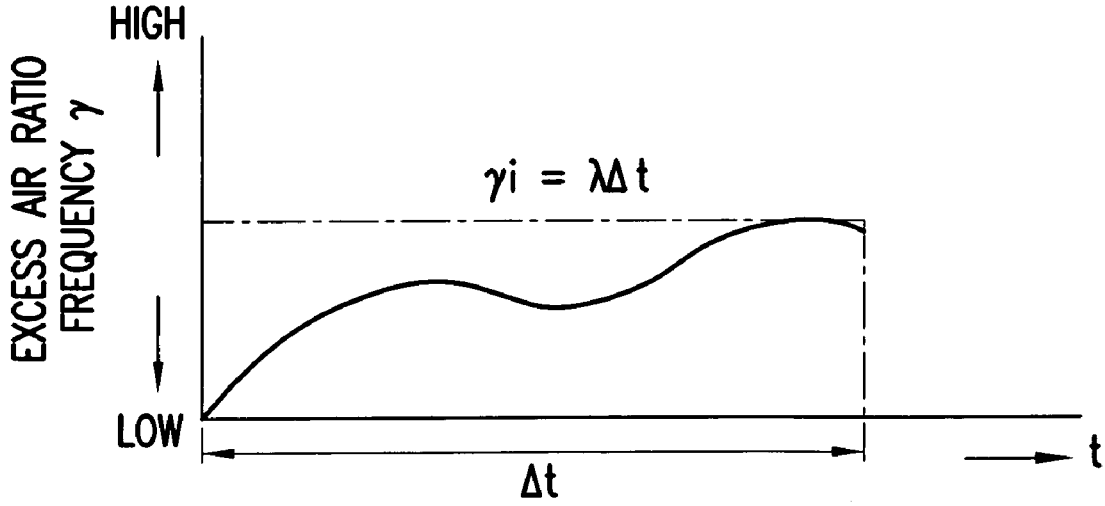
FIG. 4B shows a waveform of a moving weight average of the excess air ratio frequency.

Referring to FIG. 4B, the excess air ratio frequency $\gamma_i$ at the end of calculation in the time period Δt is assumed to be γΔt.

In this case, no large memory is necessary, and the excess air ratio frequency γ can be observed in a chorological order.

The excess air ratio frequency γi may be derived by using the formula (h).

$$\gamma i=\Delta_{i-1}\times wf+xi\times(1-wf) \quad \text{(h)}$$

where wf denotes a weighting factor, and xi denotes a current determination value. The weighting factor wf is assumed to be 0.5. The nearer the weighting factor wf becomes 1, the less influence of the previous excess air ratio frequency $\gamma_{i-1}$. The use of the excess air ratio frequency γ calculated using the weighting factor wf is effective in adjusting variations of data caused by disturbance. Therefore, the amount Me of discharged particulates can be precisely detected.

A section a2-2' calculates an amount MeΔt of particulates discharged during the time period Δt, using the formula (i).

$$Me\Delta t=f(\gamma\Delta t) \quad \text{(i)}$$

Further, the amount Me of discharged particulates may be derived by multiplying the excess air ratio frequency λΔt (in the time period Δt) by a predetermined coefficient C. The coefficient C is experimentally determined. Still further, the amount Me may be derived using a map in which the amount Me of discharged particulates is depicted on the basis of the excess air ratio frequency γΔt, in place of using the formula (i).

For instance, when the excess air ratio shown in FIG. 3A is substituted by the excess air ratio frequency γ, the amount Me of discharged particulates is depicted by a curve opposite to that of FIG. 3A, i.e. the larger the excess air ratio frequency γ, the larger the amount Me (or the higher a particulate discharging velocity θ).

A unit A2' in FIG. 8 calculates an amount Mb of burnt particulates. Specifically, the unit A2' downloads the filter temperatures gt per unit time using a section b1 for calculating a filter temperature frequency, totals the filter temperatures gt, and derives a filter temperature frequency βΔt in the time period Δt.

In the foregoing case, if the filter temperature gt is downloaded each unit time t, a large memory is required, which is not effective in view of cost. In order to overcome this problem, the filter temperature frequency βΔt may be calculated using the formula (j).

$$\beta_i=(\beta_i+\beta_{i-1}\times(i-1)/i \quad \text{(j)}$$

where $\beta_i$ denotes an i-th filter temperature frequency, and $\beta_{i-1}$ denotes a previous filter temperature frequency.

In this case, the filter temperature frequency β can be observed in chorological order without using a large memory.

A filter temperature frequency corrector b2 corrects the filter temperature frequency βΔt (in the time period Δt) using a correction coefficient in accordance with the NOx/Soot.

Particulates can be usually burnt at a lowest temperature of approximately 600° C. However, the use of the oxide catalyst 21 and oxidative reaction with $NO_2$ can reduce the lowest temperature to 250° C. Generation of $NO_2$ depends upon an amount of NOx in exhaust gas, i.e. the more NOx, the more $NO_2$. Therefore, particulates can be reliably burnt at approximately 250° C. Conversely, the less the NOx, the less $NO_2$. This means that particulates may not be burnt reliably at approximately 250° C. In other words, burning efficiency of particulates depends upon the amount of NOx in exhaust gas, and more particularly upon the NOx/Soot serving as an index which indicates whether or not exhaust gas contains components suitable to burn particulates.

Figure 5A:
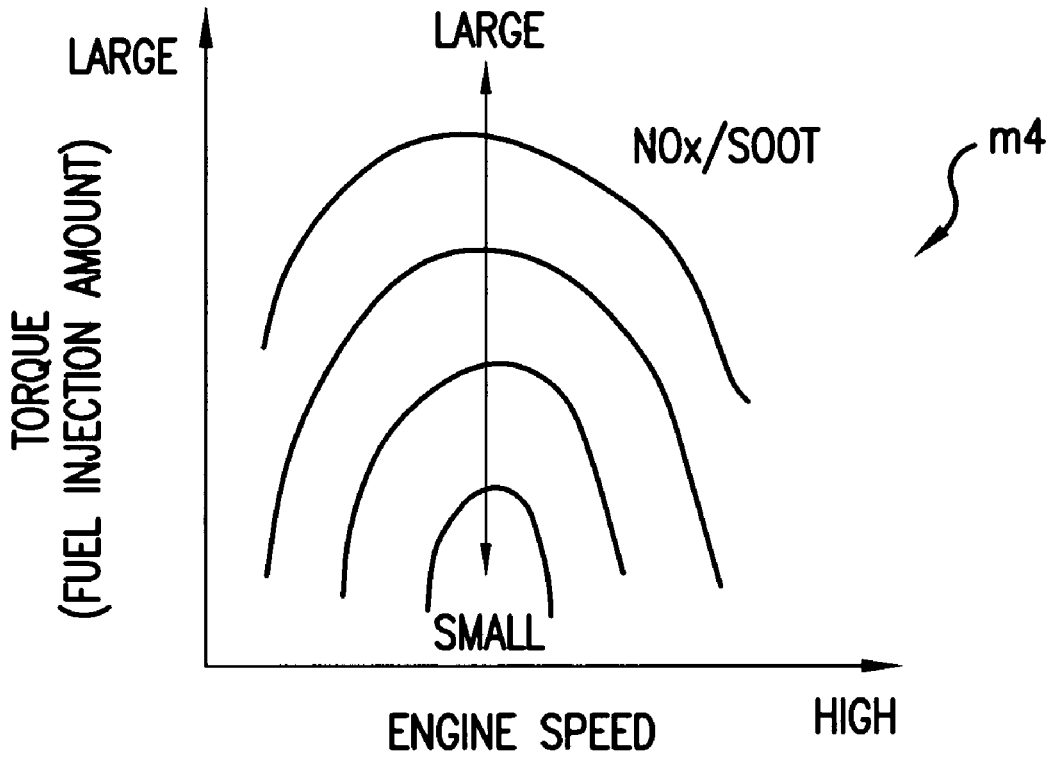
FIG. 5A shows a map for estimating NOx/Soot on the basis of a fuel injection amount and an engine speed.
Figure 5B:
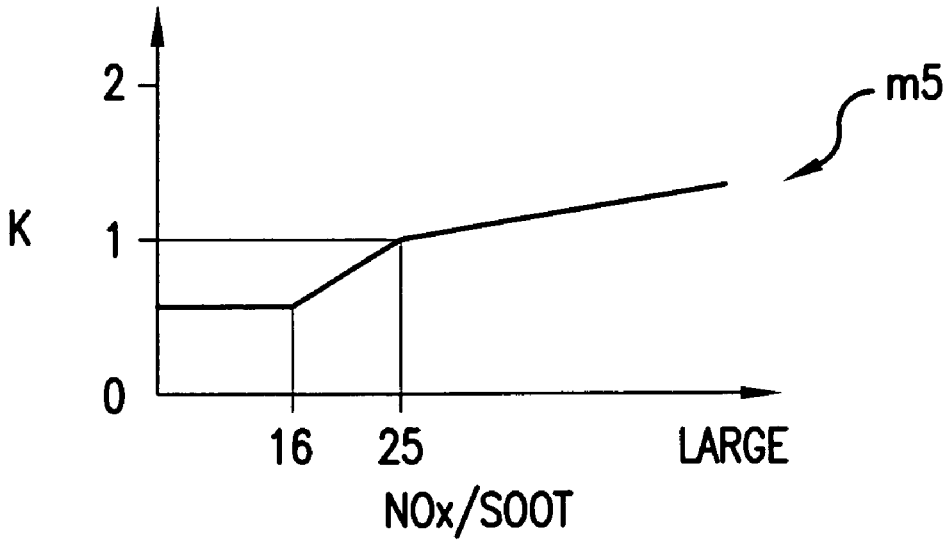
FIG. 5B shows a map for setting up a correction factor K on the basis of NOx/Soot.

For the foregoing reasons, the filter temperature frequency corrector b2 sets up the NOx/Soot in response to the engine speed Ne and the fuel injecting amount Qf (corresponding to torque) and using the NOx/Soot map m4 in FIG. 5A and a correction coefficient map m5 in FIG. 5B, and calculates a correction coefficient Ka on the basis of the NOx/Soot. For instance, if the NOx/Soot is 25 or larger, the correction coefficient K gradually exceeds 1. If the NOx/Soot is less than 25, the correction coefficient K gradually becomes smaller than 1 in response to the reduction of the NOx/Soot. Further, the correction coefficient K is set to be a steady value (<1) when the NOx/Soot is less than 16. Further, the filter temperature frequency corrector b2 multiplies the correction coefficient K with the temperature frequency β, thereby correcting the coefficient K.

A burning velocity calculator b3 calculates a particulate burning velocity coefficient αΔt in the time period Δt using the formula (k).

$$\alpha\Delta t=f(\beta\Delta t) \quad \text{(k)}$$

Figure 3B:
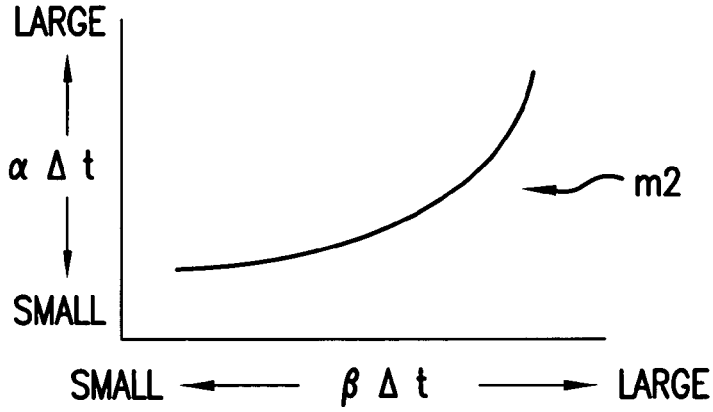
FIG. 3B shows a map for estimating a particulate burning velocity on the basis of a filter temperature frequency at which a filter or exhaust gas temperature is equal to or higher than a predetermined value.
Figure 3C:
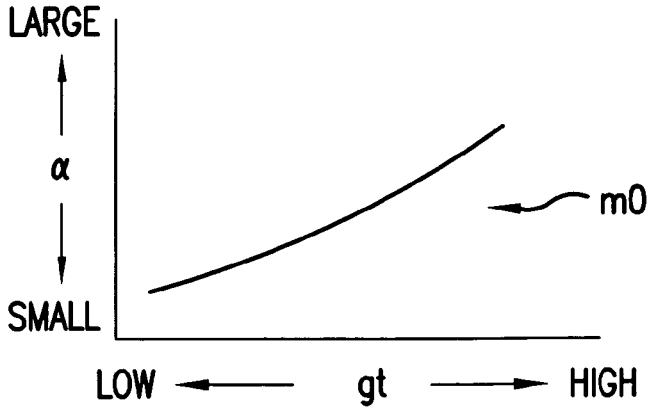
FIG. 3C shows a map for easy estimation of a burning velocity coefficient on the basis of the filter temperature frequency, the burning velocity coefficient being used at the time of forced regeneration of a filter.

The particulate burning velocity coefficient αΔt may be derived using the map m2 shown in FIG. 3B, in place of the formula (k).

Specifically, the larger the filter temperature frequency βΔt in the given time period, the larger the particulate burning velocity coefficient αΔt.

A burnt particulate amount calculator b4" calculates an amount MbΔt of particulates burnt in the time period Δt using the formula (1).

$$Mb\Delta t=\alpha\Delta t*PM_{i-1} \quad (1)$$

where $PM_{i-1}$ represents the amount of previously accumulated particulates, which is calculated by the unit A3' calculating an amount of accumulated particulates as will be described later.

Alternatively, the amount MbΔt may be derived using a map showing the relationship between the particulate burning velocity αΔt and the amount Mb of burnt particulates.

The larger the particulate burning velocity coefficient αΔt, the more the amount MbΔt.

The unit A3' calculates an amount $PM_i$ of currently accumulated particulates using the formula (m).

$$PM_i=PM_{i-1}+(Me\Delta t-Mb\Delta t)\times\Delta t \quad (m)$$

In the foregoing embodiment, the burnt particulate amount calculator b4' of the unit A2' calculates the burnt particulate amount MbΔt. Alternatively, the amount $PM_i$ of currently accumulated particulates may be calculated by the unit A3' using the formula (n) when the unit A2' is replaced by a unit A2" including the burning velocity calculator b3.

$$PM_i=PM_{i-1}+(Me\Delta t-\alpha\Delta t\times PM_{i-1})\times\Delta t \quad (n)$$

Figure 9A:
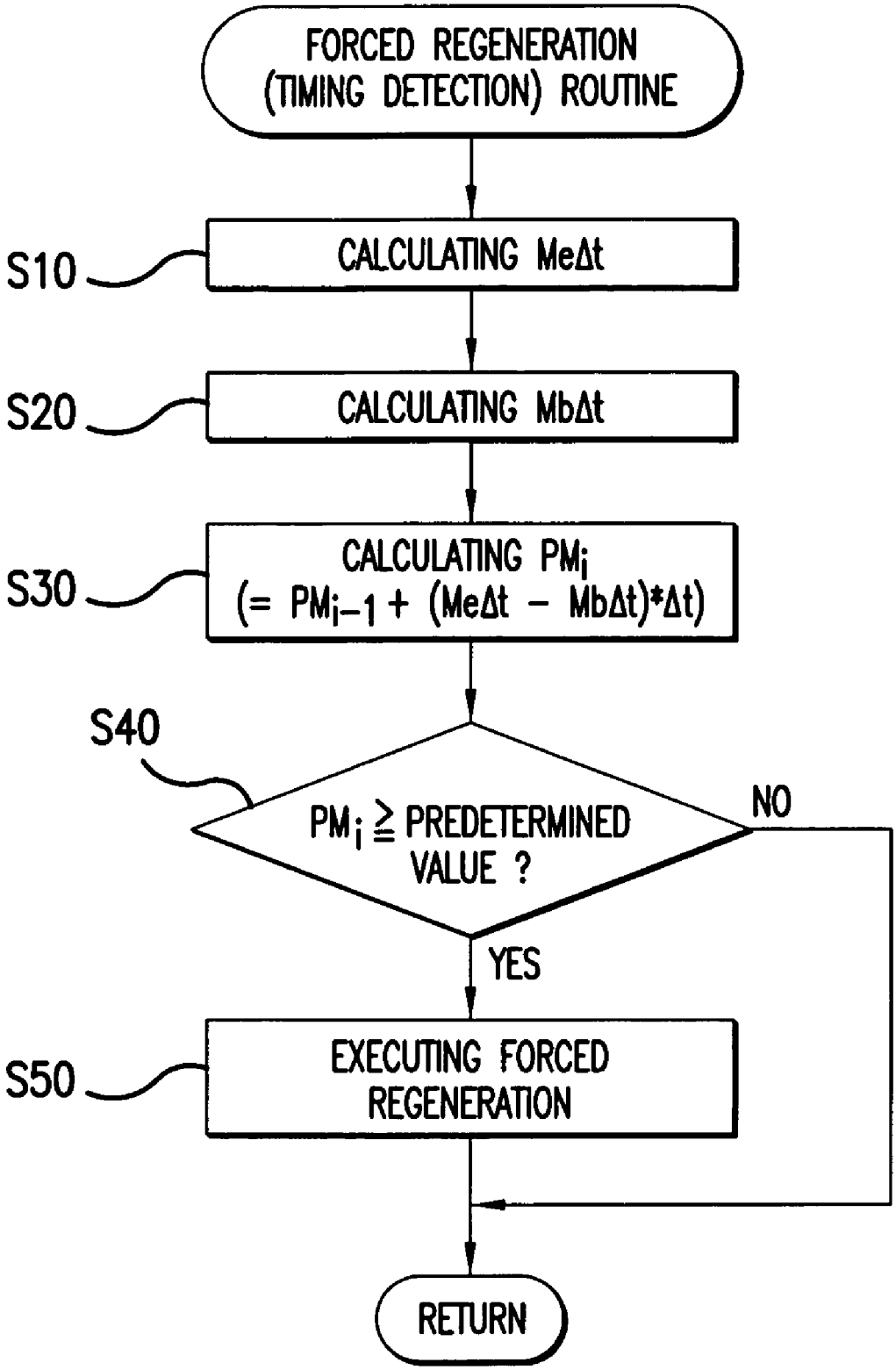
FIG. 9A is a flow chart of a forced regeneration routine of the exhaust gas purifying system of FIG. 8, especially showing a routine for detecting forced regeneration timing.

A forced regeneration routine will be described with reference to FIG. 9A to FIG. 9C. Specifically, FIG. 9A shows a forced regeneration timing detecting routine.

The amount MeΔt of particulates discharged in the time period Δt is calculated in step s10, and the amount MbΔt of burnt particulates in the time period Δt is calculated in step s20.

Figure 9B:
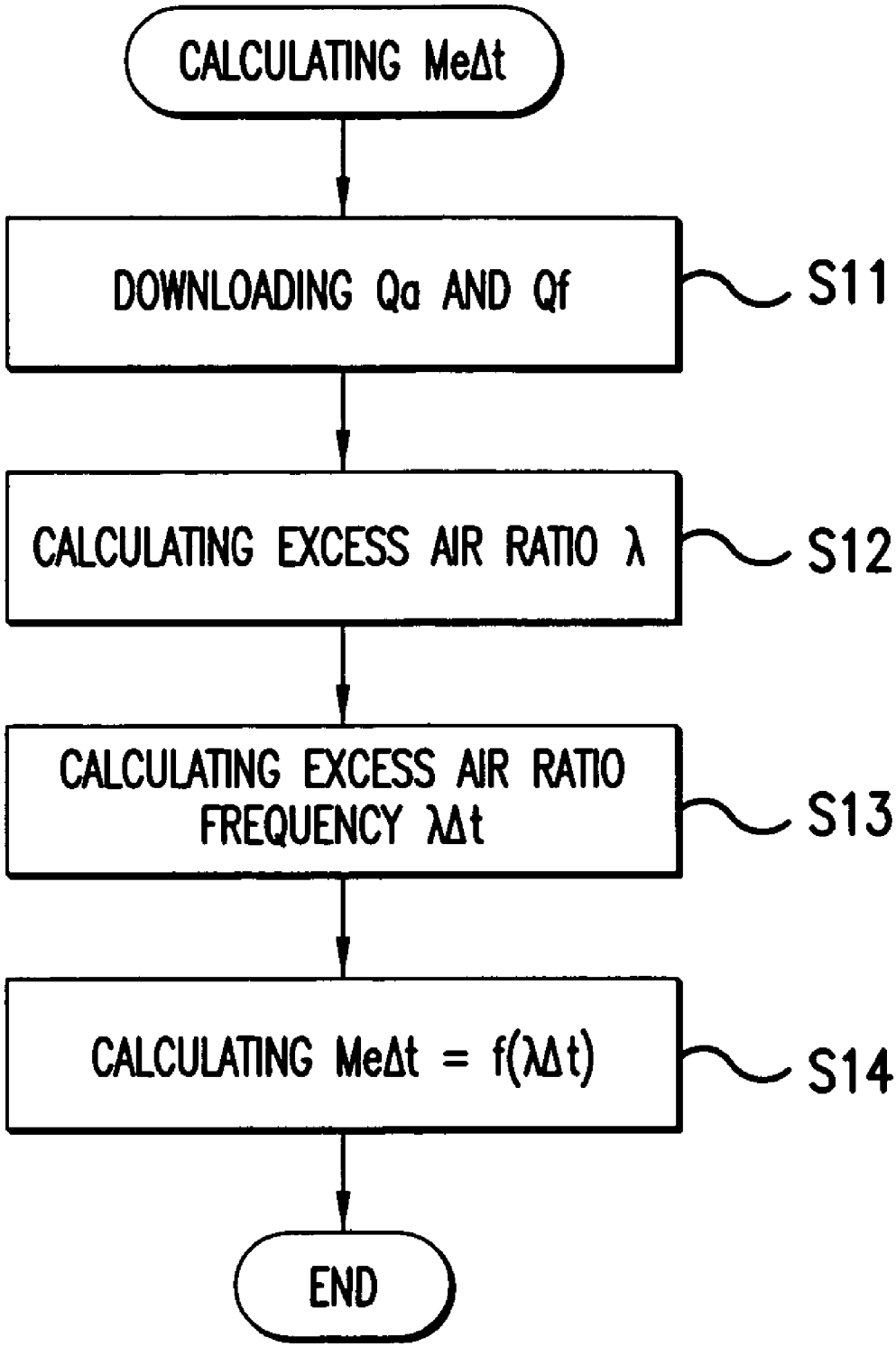
FIG. 9B is a flow chart for calculating an amount of particulates discharged during a given time period.

A routine shown in FIG. 9B is used for this purpose. In step s11, an intake air amount Qa and a fuel injection amount Qf are downloaded. In step s12, the excess air ratio λ in the time period Δt is calculated on the basis of the downloaded data. In step s13, the excess air ratio frequency γ is calculated by the excess air ratio frequency calculator a2-1' shown in FIG. 8. Finally, the amount MaΔt {=f(γΔt)} is calculated in step s14.

Figure 9C:
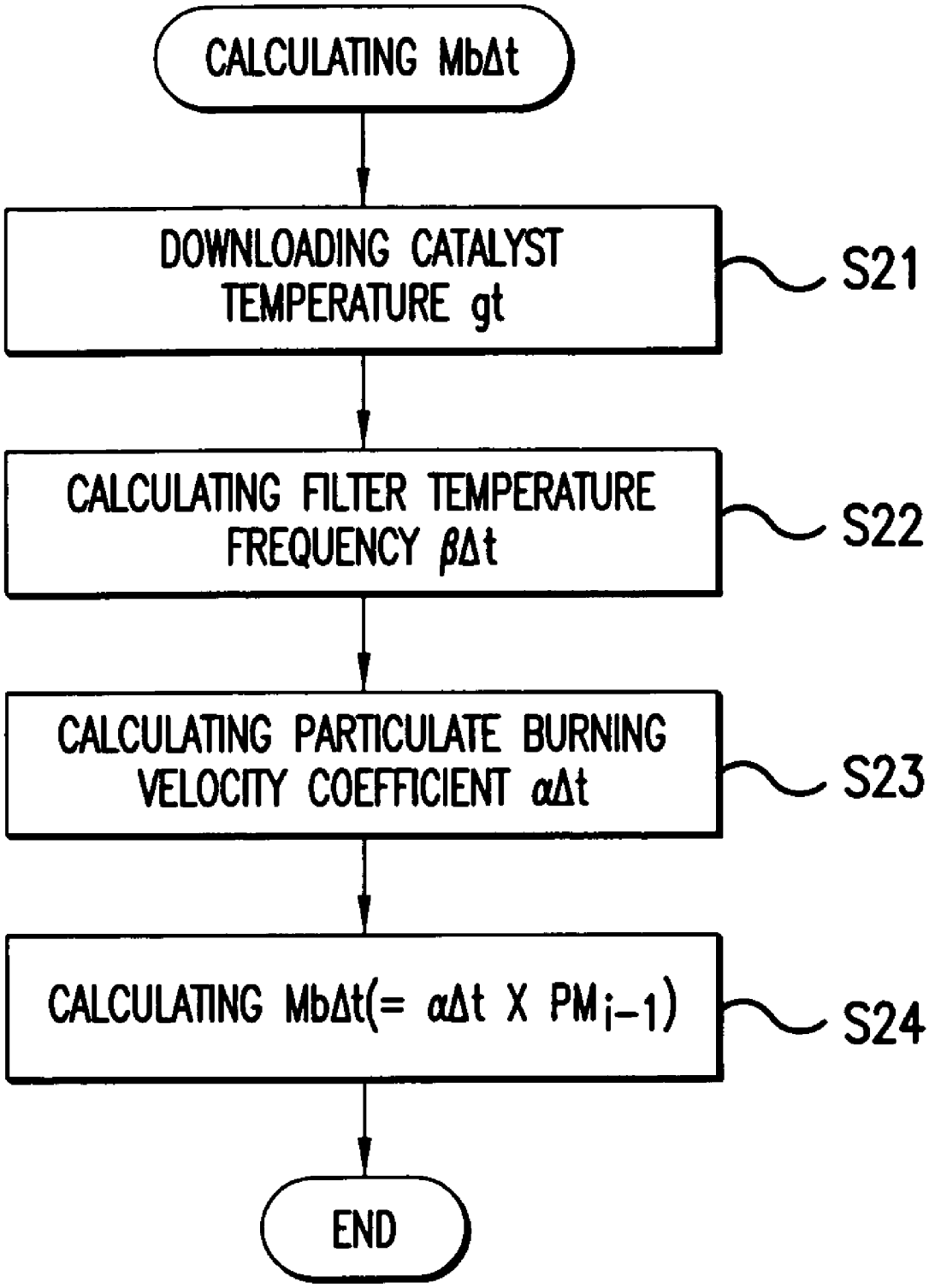
FIG. 9C is a flow chart for calculating an amount of particulates burnt during a given time interval.

The amount MbΔt of particulates burnt in the given time period Δt is calculated in a routine shown in FIG. 9C.

The catalyst temperature gt is downloaded in step s21, and the filter temperature frequency βΔt is calculated on the basis of the catalyst temperature gt in step s22, and is corrected using a correction coefficient depending K upon the NOx/Soot. In step s23, the particulate burning velocity αΔt{=f(βΔt)} is calculated using the filter temperature frequency βΔt. Finally, the amount MbΔt {=αΔt×$PM_{i-1}$} is calculated in step s24.

Following the calculations of MeΔt and MbΔt in steps s10 and s20, the amount $PM_i$ of currently accumulated particulates is calculated using $PM_{i-1}$, MeΔt and MbΔt in step 30. Refer to FIG. 9A.

When the amount $PM_i$ is detected to be equal to or larger than the predetermined value in step s40, the forced regeneration is executed in step s50 in order to forcibly heat the filter 22. For this purpose, a predetermined amount of fuel is post-injected at an appropriate timing for a necessary time interval after the main fuel injection.

Therefore, exhaust gas is heated, so that the filter temperature gt is quickly raised, and particulates are adequately burnt in a hot atmosphere. This allows reliable regeneration of the filter 22.

The amount $PM_i$ of accumulated particulates can be accurately detected by calculating the amount Me of particulates discharged in the time period Δt and the amount Mb of particulates burnt in the time period Δt. Therefore, forced regeneration intervals can be properly set up and lengthened, which is effective in preventing the reduction of fuel efficiency.

Further, the burnt particulate amount calculating unit A2' may derive the filter temperature frequency βc, where a filter temperature gt is 250° C. or higher for the time period Δt, or may derive an average of the filter temperature frequency βc in the time period Δt.

The foregoing alternatives are as effective as the forced regeneration procedure shown in FIGS. 9A to 9C. The total amount of accumulated particulates can be accurately detected, which is effective keeping the forced regeneration interval in a proper range.

In the foregoing description, the filter has the honeycomb structure. Alternatively, the filter may be in shape of a wire mesh or have a three-dimensional structure.

INDUSTRIAL APPLICABILITY

The exhaust gas purifying system of the invention can reliably detect the amount of accumulated particulates. When installed in a diesel engine vehicle, the exhaust gas purifying system can lengthen forced regeneration intervals, and improve fuel efficiency.

What is claimed is:

1. An exhaust gas purifying system for an internal combustion engine, comprising:

an exhaust-after-treatment device disposed in an exhaust system of the internal combustion engine, and including a particulate filter configured to collect particulates from exhaust gas, and an $NO_2$ generating unit upstream of or in the particulate filter;

an excess air ratio frequency calculating unit configured to calculate an excess air ratio frequency at which an excess air ratio is equal to or less than a predetermined value during the operation of the internal combustion engine;

a discharged particulate amount calculating unit configured to calculate an amount of discharged particulates on the basis of an excess air ratio frequency at which an excess air ratio is equal or less than a predetermined excess air ratio;

a filter temperature frequency calculating unit configured to calculate a filter temperature frequency at which the temperature of exhaust gas in front of the particulate filter or the temperature of the particulate filter is equal to higher than a predetermined value;

a burnt particulate amount calculating unit configured to calculate an amount of burnt particulates on the basis of the filter temperature frequency; and a particulate accumulation amount calculating unit configured to calculate an amount of particulates on the particulate filter on the basis of the calculated amount of discharged particulates and the calculated amount of burnt particulates.

2. The exhaust gas purifying system of claim 1, wherein: the discharged particulate amount calculating unit calculates an amount of particulates discharged in a given time period during which the excess air ratio is equal to or less than the predetermined value; the burnt particulate amount calculating unit includes a burning velocity calculating section which calculates a velocity for burning particulates on the particulate filter on the basis of the filter temperature frequency, and derives an amount of particulates burnt in the given time period on the basis of the particulate burning velocity in the given time period and the amount of particulates accumulated in the given time period; and the particulate accumulation amount calculating unit calculates an amount of currently accumulated particulates on the basis of the amount of previously accumulated particulates, the amount of particulates discharged during the given time period, and the amount of particulates burnt in the given time period.

3. The exhaust gas purifying system of claim 1, wherein the calculation of the amount of discharged particulates includes: downloading data on an amount of intake air and data on an amount of injected fuel: calculating an excess air ratio $\lambda$ in a given time period $\Delta t$ on the basis of the amount of intake air and the amount of injected fuel; calculating an excess air ratio frequency $\gamma\Delta t$, in which the excess air ratio $\lambda$ is equal to or less than the predetermined value in the given time period $\Delta t$, and calculating the amount of discharged particulates $Me\Delta t$ $\{=f\lambda\Delta t\}$, the foregoing procedures being conducted in the named order.

4. The exhaust gas purifying system of claim 1, wherein the calculation of the amount of burnt particulates includes: downloading the catalyst temperature gt; calculating a filter temperature frequency $\beta\Delta t$ in the given time period $\Delta t$ on the basis of the catalyst temperature gt; correcting the filter temperature frequency $\beta\Delta t$ using a correction factor K which depends upon an index NOx/Soot representing that components of exhaust gas are suitable for burning particulates; calculating a particulate burning velocity coefficient $\alpha\Delta t$ $\{=f(\beta\Delta t)\}$ for the given time period $\Delta t$; and calculating an amount $Mb\Delta t$ $\{\alpha\Delta t \times PM_{i-1}\}$ of burnt particulates on the basis of an amount $PM_{i-1}$ of previously accumulated particulates and the particulate burning velocity coefficient $\alpha\Delta t$, the foregoing procedures being conducted in the named order.

* * * * *